US007226158B2

(12) United States Patent
Moore et al.

(10) Patent No.: US 7,226,158 B2
(45) Date of Patent: Jun. 5, 2007

(54) PRINTING SYSTEMS

(75) Inventors: Steven Robert Moore, Rochester, NY (US); Robert Michael Lofthus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 325 days.

(21) Appl. No.: 11/051,817

(22) Filed: Feb. 4, 2005

(65) Prior Publication Data

US 2006/0176336 A1 Aug. 10, 2006

(51) Int. Cl.
*B41J 2/01* (2006.01)

(52) U.S. Cl. ..... 347/101; 347/104

(58) Field of Classification Search ..... 347/101, 347/104, 41

See application file for complete search history.

(56) References Cited

U.S. PATENT DOCUMENTS 4,397,542 A 8/1983 Brodesser
4,579,446 A 4/1986 Fujino et al.
4,587,532 A 5/1986 Asano
4,591,884 A 5/1986 Miyamoto et al.
4,836,119 A 6/1989 Siraco et al.
4,972,236 A * 11/1990 Hasegawa ..... 399/16
5,004,222 A 4/1991 Dobashi
5,041,866 A 8/1991 Imoto
5,080,340 A 1/1992 Hacknauer et al.
5,095,342 A 3/1992 Farrell et al.
5,150,167 A 9/1992 Gonda et al.
5,159,395 A 10/1992 Farrell et al.
5,208,640 A 5/1993 Horie et al.
5,233,388 A 8/1993 Reese et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Thinh Nguyen
(74) *Attorney, Agent, or Firm*—Eugene O. Palazzo; Fay Sharpe LLP

(57) ABSTRACT

A system includes at least first and second marking modules, each of the marking modules including a marking engine and at least one media feeder which feeds print media to the marking engines. First and second output modules receive print media from the first and second marking modules. The first and second output modules each include a finisher. At least one print media network selectively conveys print media between each of the marking modules and each of the output modules. The first and second output modules each include a portion of the print media network, the portion extending between an inlet interface and an outlet interface of the module.

24 Claims, 6 Drawing Sheets

U.S. PATENT DOCUMENTS

| | | | | |
|---|---|---|---|---|
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,269,237 | B1 * | 7/2001 | Olbrich et al. | 399/401 |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,654,136 | B2 | 11/2003 | Shimada | |
| 6,819,906 | B1 | 11/2004 | Herrmann et al. | |
| 6,925,283 | B1 | 8/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.

* cited by examiner

PRINTING SYSTEMS

CROSS REFERENCE TO RELATED APPLICATIONS

The following applications, the disclosures of each being totally incorporated herein by reference are mentioned:

U.S. application Ser. No. 10/917,768, filed Aug. 13, 2004, for PARALLEL PRINTING ARCHITECTURE CONSISTING OF CONTAINERIZED IMAGE MARKING ENGINES AND MEDIA FEEDER MODULES by Robert Lofthus;

U.S. application Ser. No. 10/924,106, filed Aug. 23, 2004, for PRINTING SYSTEM WITH HORIZONTAL HIGHWAY AND SINGLE PASS DUPLEX by Lofthus, et al.;

U.S. application Ser. No. 10/924,113, filed Aug. 23, 2004 for PRINTING SYSTEM WITH INVERTER DISPOSED FOR MEDIA VELOCITY BUFFERING AND REGISTRATION by deJong, et al.;

U.S. application Ser. No. 10/924,458, filed Aug. 23, 2004 for PRINT SEQUENCE SCHEDULING FOR RELIABILITY by Lofthus, et al.; and U.S. application Ser. No. 10/924,459, filed Aug. 23, 2004, FOR PARALLEL PRINTING ARCHITECTURE USING IMAGE MARKING ENGINE MODULES by Mandel, et al.,;

BACKGROUND

The present embodiment relates to a system in which the output from a plurality of image marking engines is selectively directed to one of a plurality of output modules which supply a finishing function. It finds particular application in conjunction with an integrated system of printers, each having the same or different printing capabilities, which feed printed media via a common network to a plurality of finishing modules, and will be described with particular reference thereto. However, it is to be appreciated that the present exemplary embodiment is also amenable to other like applications.

In a typical xerographic apparatus, such as a copying or printing device, an electronic image is transferred to a print medium, such as paper. In a xerophotographic process, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with developing powder referred to in the art as toner. This image may subsequently be transferred to a support surface, such as paper, to which the toner image is permanently affixed in a fusing process. In a multicolor electrophotographic process, successive latent images corresponding to different colors are formed on the insulating member and developed with a respective toner. Each single color toner image is transferred to the paper sheet in superimposed registration with the prior toner image. For simplex printing, only one side of a sheet is printed, while for duplex printing, both sides are printed.

Other printing processes are known in which the electronic signal is reproduced as an image on a sheet by other means, such as through impact (e.g., a type system or a wire dot system), or through use of a thermosensitive system, ink jets, laser beams, or the like. To meet demands for higher outputs of printed pages, one approach has been to increase the speed of the printer, which places greater demands on each of the components of the printer.

Another approach has been to develop printing systems which employ several small marking engines. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different printers, such as separate printing of the color and monochrome pages. Examples of such a system are described in above-mentioned application Ser. Nos. 10/924,459 and 10/917,768. Such a system feeds paper from a common source to a plurality of printers, which may be horizontally and/or vertically stacked. Printed media from the various printers is then taken from the printer to a finisher where the sheets associated with a single print job are assembled.

Print shops and other users of such systems seek an increased variety of functions in the finisher to meet customer demands. The finisher may incorporate several different functions, such as folding, stapling, collating, binding, and the like. As a result, a typical finisher represents a substantial investment. As a new function becomes available or is improved, a print shop which does not have a finisher which delivers that function may loose a portion of its business.

BRIEF DESCRIPTION

Aspects of the present disclosure in embodiments thereof include system and a method of printing. The system includes first and second marking modules, each of the marking modules including a marking engine. At least one media feeder feeds print media to the marking engines. First and second output modules receive print media from the first and second marking modules. The first and second output modules each include a finisher. At least one print media network selectively conveys print media between each of the marking modules and each of the output modules, the first and second output modules each defining a portion of the print media network. The portion extends between an inlet interface and an outlet interface.

The method of printing includes feeding print media to first and second marking engines, marking the print media with the first and second marking engines, conveying the print media from the first and second marking engine to a selected one of first and second output modules, and performing a finishing process in the one of the first and second output modules, wherein the conveying of the print media includes conveying the print media on print media network, each of the output modules including a portion of the print media network.

The term "marking engine" or "printer," as used herein broadly encompasses a device for applying an image to print media, unless otherwise defined in a claim.

A "printing assembly," as used herein incorporates a plurality of marking engines, and may include other components, such as finishers, paper feeders, and the like and encompasses copiers and multifunction machines, as well as assemblies used for printing.

The term "sheet" herein refers to a usually flimsy physical sheet of paper, plastic, or other suitable physical print media substrate for images, whether precut or web fed.

A "print job" is normally a set of related sheets, usually one or more collated copy sets copied from a set of original document sheets or electronic document page images, from a particular user, or which are otherwise related.

A "finisher," as broadly used herein, is any post-printing accessory device such as a sorter, mailbox, inserter, interposer, folder, stapler, stacker, hole puncher, collater, stitcher, binder, envelope stuffer, postage machine, or the like.

DETAILED DESCRIPTION

Figure 1:
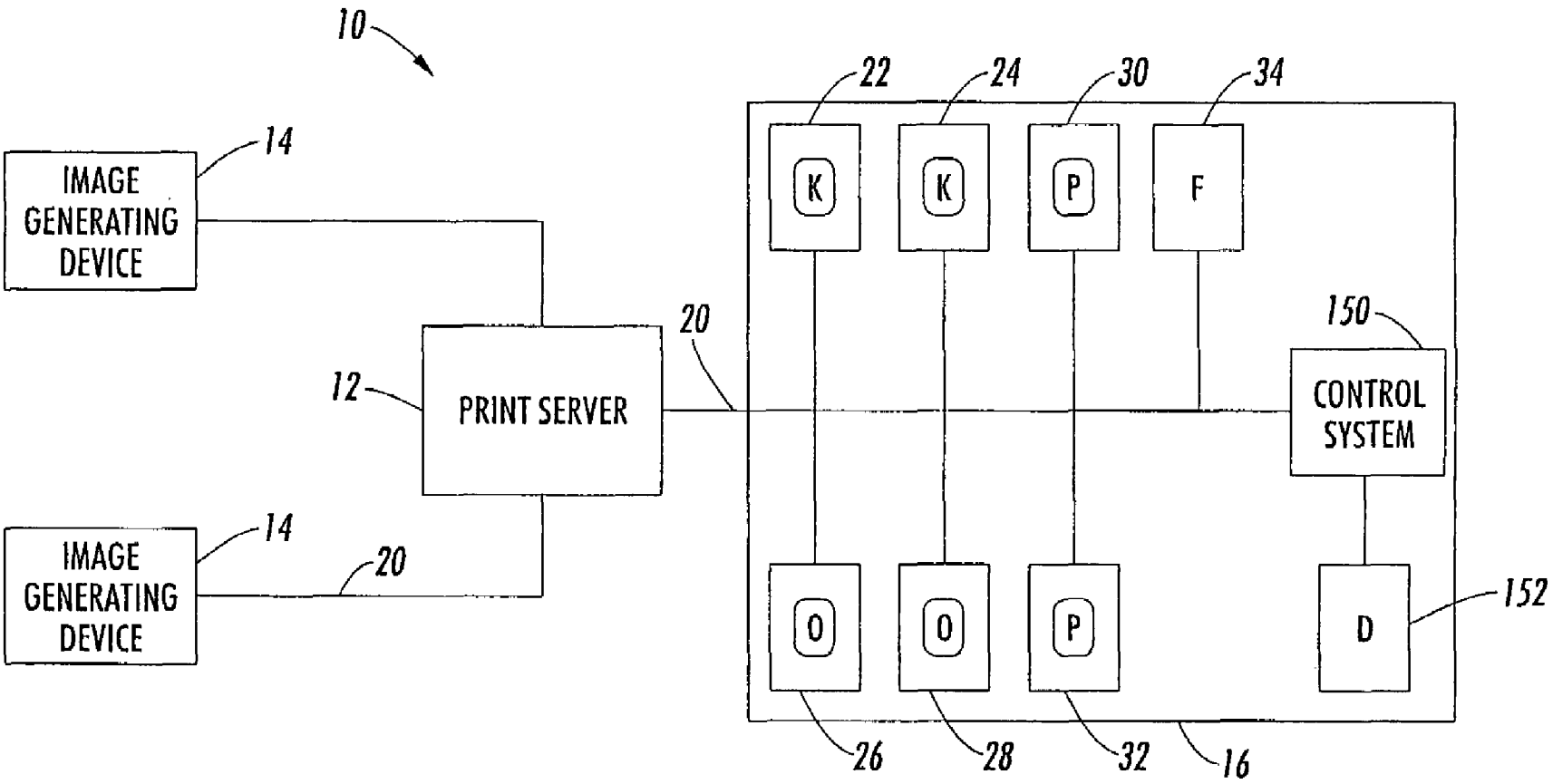
FIG. 1 is a schematic view of a printing system according to one embodiment.

The embodiments, to be described below, relate to a printing system which includes a plurality of image marking engines (marking engines), linked by a common network of pathways which connects the marking engines with each other and with a plurality of output modules. The printing system has a modular architecture which allows docking of marking engine modules and output modules. The image marking engines and output modules can be cascaded together with any number of other marking engines and/or feeder modules to generate higher speed configurations. Each marking engine and/or output module may be disconnected from the printing system for repair or replacement while the rest of the system retains processing capability. To that end, the modules may be configured for direct interconnection with other modules or with a framework on which the modules are supported. In one embodiment, some or all of the marking engine modules and/or output modules are interchangeable, allowing, for example, a marking engine to be replaced by another marking engine module or with an output module, and vice versa.

The printing system may incorporate "tandem engine" printers, "parallel" printers, "cluster printing," "output merger," or "interposer" systems, and the like, as disclosed, for example, in U.S. Pat. No. 4,579,446 to Fujino; U.S. Pat. No. 4,587,532 to Asano; U.S. Pat. No. 5,489,969 to Soler, et al.; U.S. Pat. No. 5,568,246 to Keller, et al.; U.S. Pat. No. 5,570,172 to Acquaviva; U.S. Pat. No. 5,596,416 to Barry, et al.; U.S. Pat. No. 5,995,721 to Rourke et al; U.S. Pat. No. 6,554,276 to Jackson, et al.; U.S. Pat. No. 6,607,320 to Bobrow, et al., U.S. Pat. No. 6,654,136 to Shimada; and above-mentioned application Ser. Nos. 10/924,459 and 10/917,768, the disclosures of all of these references being incorporated herein by reference. A parallel printing system is one in which two or more printers are configured for contemporaneously printing portions of a single print job and may employ a single paper source which feeds paper from a common paper stream to a plurality of printers, which may be horizontally and/or vertically stacked. Printed media from the various printers is then taken from the printer to a finisher where the sheets associated with a single print job are assembled. Variable vertical level, rather than horizontal, input and output sheet path interface connections may be employed, as disclosed, for example, in U.S. Pat. No. 5,326,093 to Sollitt.

Each output module provides at least one finishing capability, and in one embodiment, two or more finishing capabilities. Finishing capabilities may include, for example, post marking operations, such as sorting, folding, stapling, stacking, collating, hole punching, gluing, stitching, stapling, binding, envelope stuffing, postage application, and the like. The finishing capabilities of one output module may be the same as that of another output module or different. For example, one output module may supply collating, stapling, and binding functions, while another output module may supply collating and folding functions.

Suitable marking engines include electrophotographic printers, ink-jet printers, including solid ink printers, thermal head printers that are used in conjunction with heat sensitive paper, and other devices capable of marking an image on a substrate. The marking engines may be of the same modality (e.g., black (K), custom color (C), process color (P), or magnetic ink character recognition (MICR) (M)) or of different print modalities. Marking engines may be capable of generating more than one type of print modality, for example, black and process color. It is to be appreciated that each of the marking engines can include an input/output interface, a memory, a marking cartridge platform, a marking driver, a function switch, a controller and a self-diagnostic unit, all of which can be interconnected by a data/control bus. Each of the marking engines can have a different processing speed capability.

Each marking engine can be connected to a data source over a signal line or link. The data source provides data to be output by marking a receiving medium. The data source can include, for example, a scanner, digital copier, digital camera, facsimile device that is suitable for generating electronic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. The link connecting the image data source to the marking engine can include, for example, a direct cable connection, public switched telephone network, wireless transmission channel, connection over a wide area network or a local area network, intranet or internet connection, or a connection over any other distributed processing network or system.

In the illustrated embodiments, multiple marking engines and output modules are shown tightly coupled to or integrated with one another in a variety of combinations thereby enabling high speed printing and low run costs, with a high level of up time and system redundancy.

With reference to FIG. 1, an exemplary printing system 10 includes a print server 12, which receives image data from a computer network, scanner, or other image generating device 14, and a printing assembly 16 capable of printing onto a print medium, all interconnected by links 20. The links 20 can be a wired or wireless link or other means capable of supplying electronic data to and/or from the connected elements. The exemplary printing assembly 16 includes a plurality of image marking modules 22, 24, 26, 28 and a plurality of output modules 30,32. While the marking modules are exemplified, in the illustrated embodiment, by four marking modules 22, 24 26, 28, and two output modules 30,32, it will be appreciated that fewer or more than four marking modules, such as one, two, five, or six marking modules, and/or fewer or more than two output modules may be employed, such as one three, or four output modules.

Figure 2:
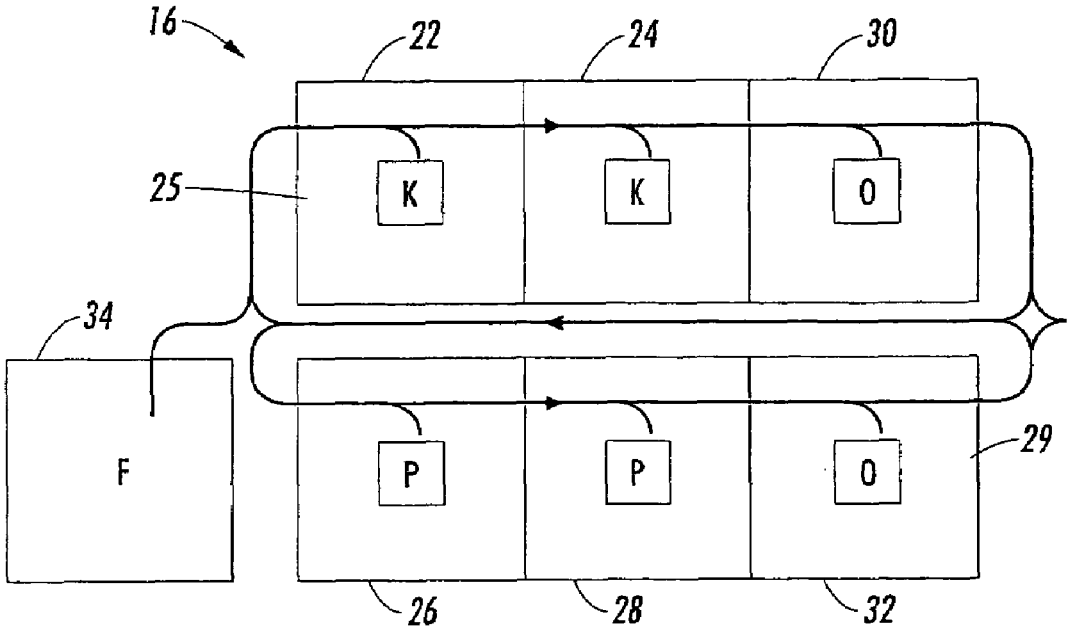
FIG. 2 is schematic view of a first embodiment of a printing assembly comprising marking engine modules and output modules showing the main highways connecting the modules.

With reference now to FIG. 2, an exemplary printing assembly 16, illustrated schematically, consists of several identical or different parallel printer modules 22, 24, 26, 28. The printer modules may be of the same modality (e.g., black (K), custom color (C), process color (P), or magnetic ink character recognition (MICR) (M)) or of different print modalities. In the illustrated embodiment, printer modules 22 and 24 print black, modules 26 and 28 print process color. While black modules 22, 24 are shown in the same horizontal row 25, color modules in a separate row 29, and output modules 30, 32 shown one in each row, it will be appreciated that black modules 22, 24 may be in different rows, as may be the color modules 26, 28. At any one time, a plurality of the printer modules can be printing. More than one of the printer modules can be employed in printing a single print job. More than one print job can be in the course of printing at any one time. By way of example, a single print job may use one or more printer modules of a first modality (such as black only) and/or one or more printer modules of a second modality (such as process color or custom color). Print media may be printed using two or more printer modules of different modalities or by two or more printer modules of the same modality. The modules 22,24, 26,28 all communicate with the network print server 12. Each of the marking modules 22, 24, 26, 28 includes one or more marking engines. It will be appreciated that the printing system 10 may include fewer or more modules, depending on the anticipated print volume.

One or more print media feed systems 34, illustrated as a feeder module in FIG. 2, supplies print media to the marking modules 22, 24, 26, 28 and ultimately to the output modules 30,32. A feeder module of this type is described for example, in above-mentioned application Ser. No. 10/917,768. In addition to the modules described herein, the printer assembly 16 may include additional modules, such as modules for collection of waste media and modules which apply a post printing treatment to the imaged print media, and the like.

The architecture, described above, enables the use of multiple marking engines within the same system and can provide simplex and duplex printing as well as multi-pass printing. In single pass duplexing, one side of a sheet is printed on one marking engine, while the second side is printed on a second marking engine. In conventional duplex printing, the sheet is recirculated back to the first engine for printing the second side. In multi-pass printing, one side of a sheet is printed on one marking engine, and the same side is printed on another marking engine. A single sheet of paper may be marked by two or more of the printers or marked a plurality of times by the same printer, before reaching an output module.

Figure 3:
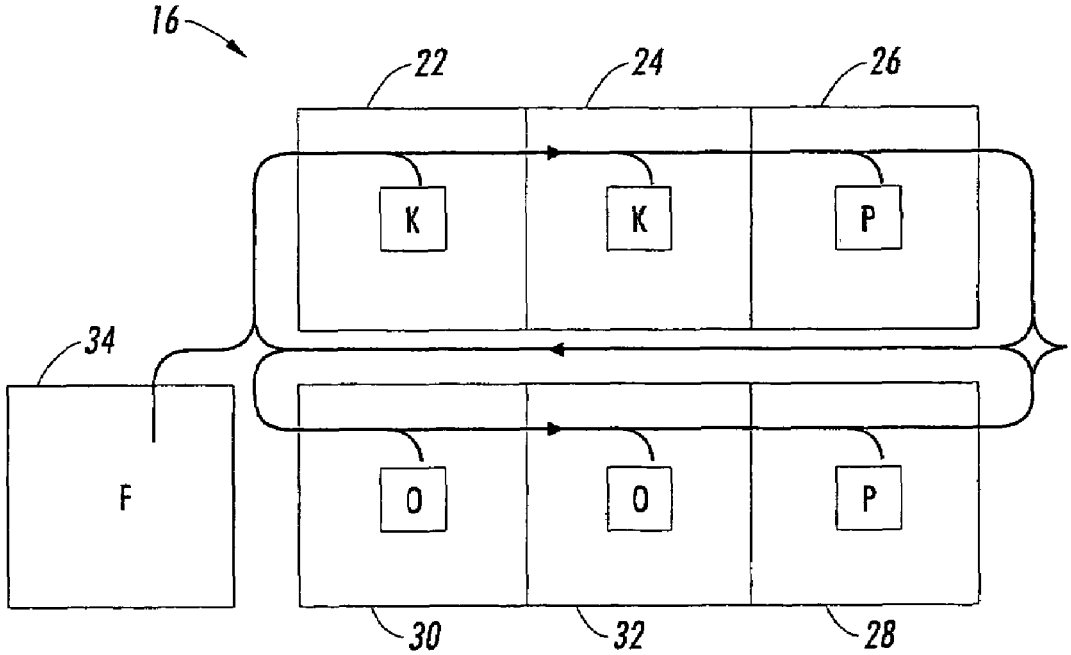
FIG. 3 is schematic view of a second embodiment of a printing assembly comprising marking engines and output modules.

FIG. 2 illustrates a printing assembly 16 in which the feeder module is at one end of the printing assembly and the output modules are at the other. In other configurations, the positions of the modules can be arranged in a different order. For example, FIG. 3 illustrates a configuration of a printing assembly in which the output modules are located adjacent to the feeder module. The modules 22, 24, 26, 28, 30, 32 and 34 can be stacked vertically and/or horizontally or in other orientations. In one embodiment, the printing assembly of FIG. 2 may be reconstructed as that of FIG. 3 by physically interchanging two of the printer modules with two of the output modules. In the same manner a variety of different configurations can be achieved, which enable the printer assembly configuration to meet space and other limitations of its location.

Figure 4:
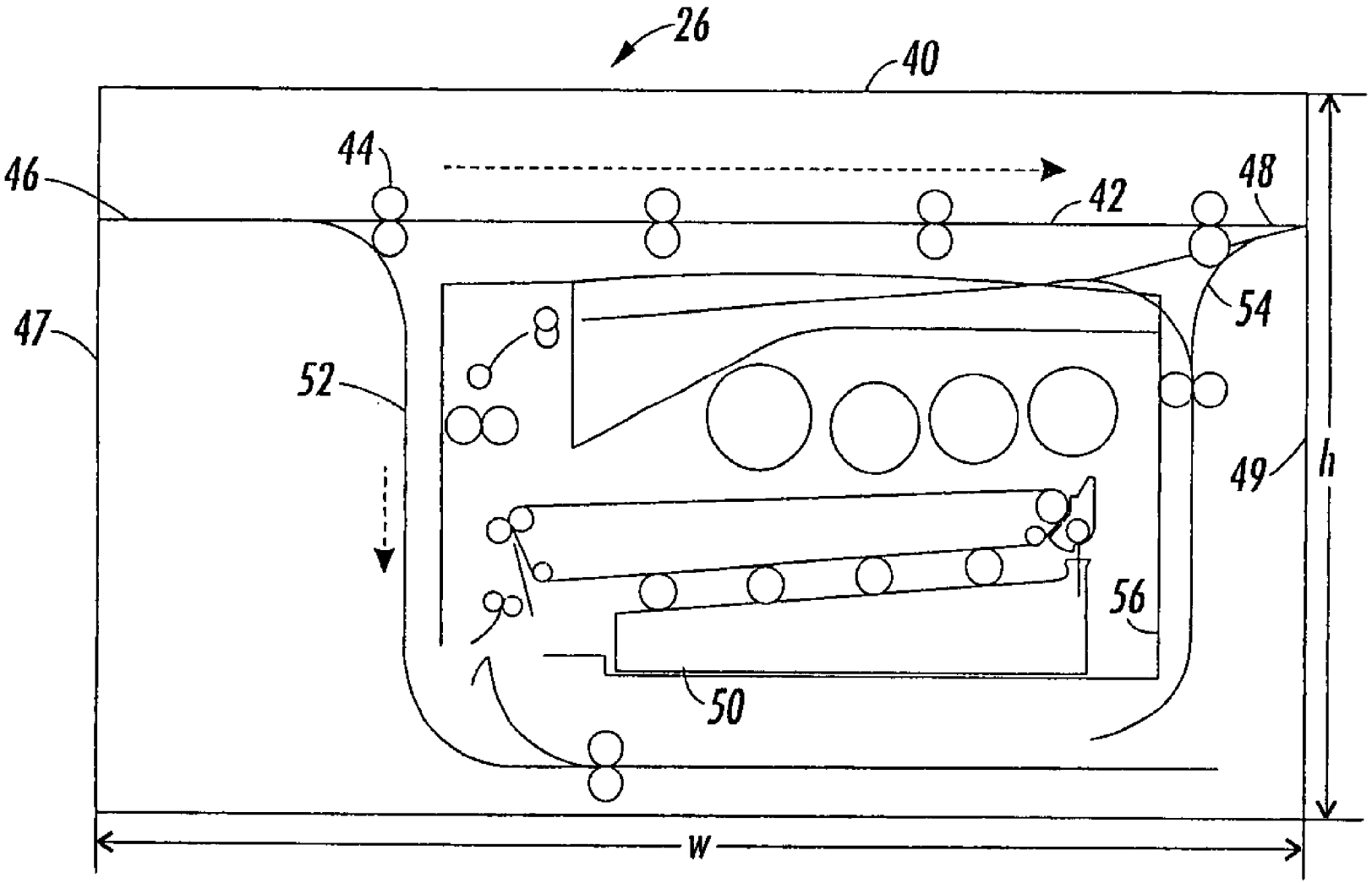
FIG. 4 is a schematic side view of an exemplary marking module.

FIG. 4 illustrates an exemplary marking module 26 for process color printing, although it will be appreciated that modules for other print modalities such as black, custom color and MICR can be similarly configured. The marking module 26 includes a housing illustrated as a box-shaped container 40. In one embodiment, the housing 40 is of the same general size and shape as the other marking modules 22, 24, 28 and/or output modules 30, 32 to allow for ease of interchangeability. In particular, each of the modules in the same row 25 or 29, or indeed all the modules have a similar or identical footprint. In the case of modules which are horizontally and vertically stacked as illustrated, this implies that height h and width w of the modules are similar or the same for each module in the row. In the case of modules which are stacked in other directions, the dimensions in the directions of stacking are similar. Thus for modules stacked in three dimensions, all three dimensions of a module can be consistent from one module to another.

The module 26 carries a paper pathway 42 which forms a portion of a print media highway along which print media is transported between modules. In the illustrated embodiment, the highway is traveling in the direction of the arrow shown. The paper pathway 42, and other paper pathways in the printing assembly, includes a plurality of drive elements 44, illustrated as pairs of rollers, although other drive elements, such as airjets, spherical balls, and the like are also contemplated. The pathway includes an inlet interface 46 in a first wall 47 of the housing 40 and an outlet interface 48 in a second wall 49 of the housing, which may be at opposite end of the housing from the first wall, as shown.

A marking engine 50 is carried by the housing 40, e.g., is within the housing. The marking engine includes components suitable for forming an image on the print media and fixing the image thereto. In the case of an electrographic device, the marking engine typically includes a charge retentive surface, such as a photoconductor belt or drum, a charging station for each of the colors to be applied (four in the illustrated embodiment), an image input device which forms a latent image on the photoreceptor, and a toner developing station associated with each charging station for developing the latent image formed on the surface of the photoreceptor by applying a toner to obtain a toner image. A pretransfer charging unit charges the developed latent image. A transferring unit transfers the toner image thus formed to the surface of a print media substrate, such as a sheet of paper. A fuser fuses the image to the sheet. Alternatively, the fuser may be located elsewhere in the housing 40. Other imaging devices are also contemplated.

Print media can be directed between the main highway and the marking engine via input and output pathways 52, 54, or bypass the marking engine along pathway 42. The highway pathway 42 and/or pathways 52 and 54 may include inverters, reverters, interposers, bypass pathways, and the like as known in the art to direct the print substrate between the highway and a selected printer or between two printers. Where a module includes two or more marking engines, additional pathways are provided for enabling transfer between the marking engines is provided.

In the illustrated embodiment, the marking engine 50 is a replaceable submodule which can be removed from the housing 40 for repair or replacement without affecting the ability for print media to travel along the highway portion 42. As shown, the submodule 50 includes its own housing 56 which houses the various components for forming an image on the print media.

Figure 5:
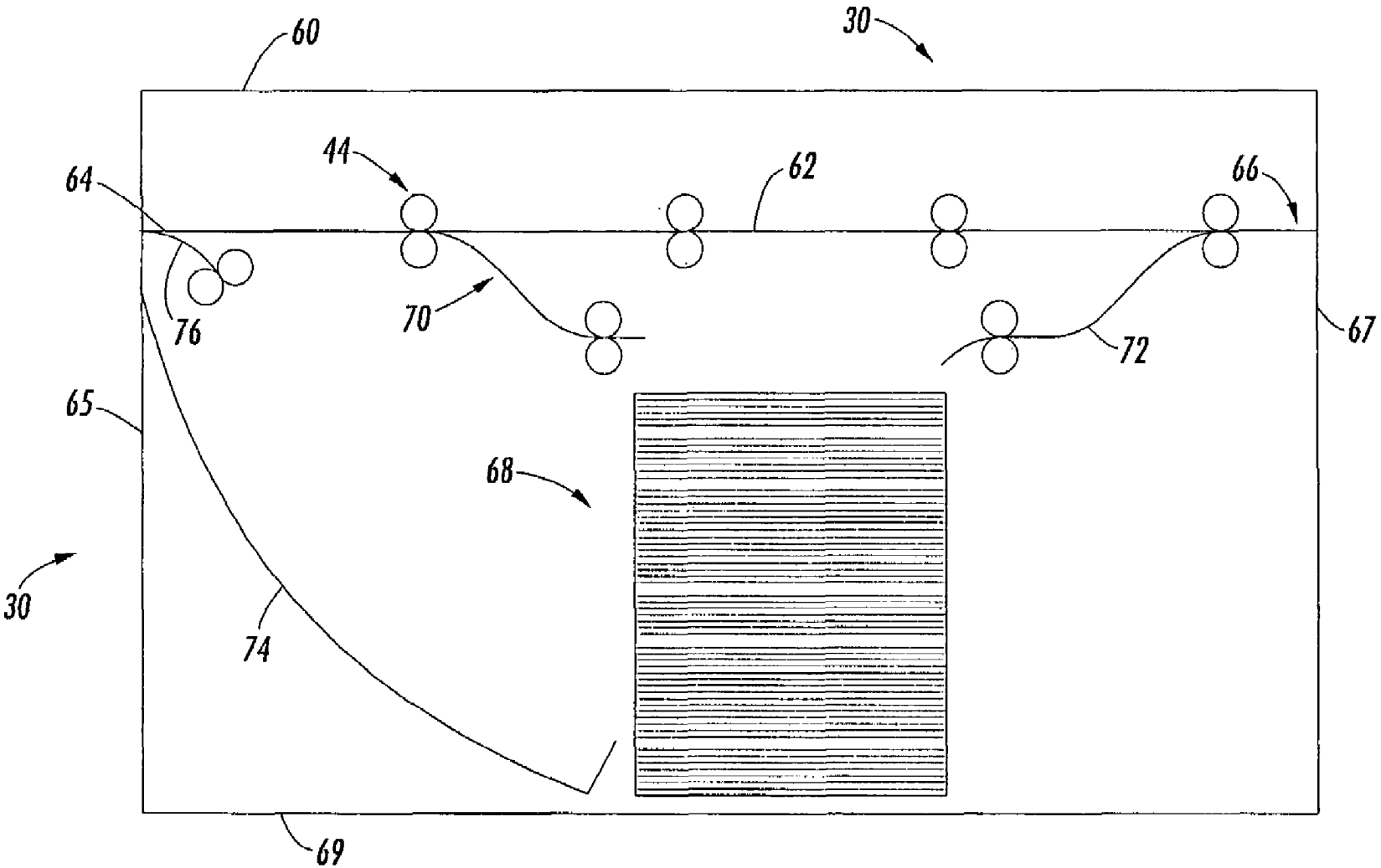
FIG. 5 is a schematic side view of an exemplary output module.

With reference to FIG. 5, an exemplary output module 30 is shown. As for the printing modules 22, 24, 26, 28, the output modules each include a housing 60, such as a container, and a pathway 62, which forms a portion of a print media highway. The pathway 62 has an inlet interface 64 in a wall 65 of the housing 60 and an outlet interface 66 in an opposite wall 67. As can be seen, the inlet interface 64 and outlet interface 66 of the output module are similarly configured to those of the printer module 26 and located for alignment with the respective outlet and inlet interfaces of adjacent modules (e.g., at the same height above a base 69 of the housing 40, 60). In this way the output module serves to interconnect other portions of the print media highway, rather than a dead end.

At least one finisher 68 is carried by the housing, illustrated in the present embodiment by a stacker submodule. As with printer submodules 50, the finisher submodule(s) 68 may be removable from the housing 60 for repair and/or replacement. The output module includes an inlet pathway 70 for directing print media from the highway pathway 62 to the finisher 68 and may also include an outlet pathway 72, for returning printed media which has undergone finishing function back to the highway. In this way, printed media which has undergone one or more finishing functions in a first output module 30 may be directed to a second output module 32 to undergo a second finishing function. Where an output module includes two or more finishing functions, additional pathways are provided for enabling these functions to be performed, either sequentially and/or alternatively. The module 50 may also include a discard tray 74 for collecting printed media to be discarded, which is receives printed media from highway 62 by a pathway 76.

Figure 6:
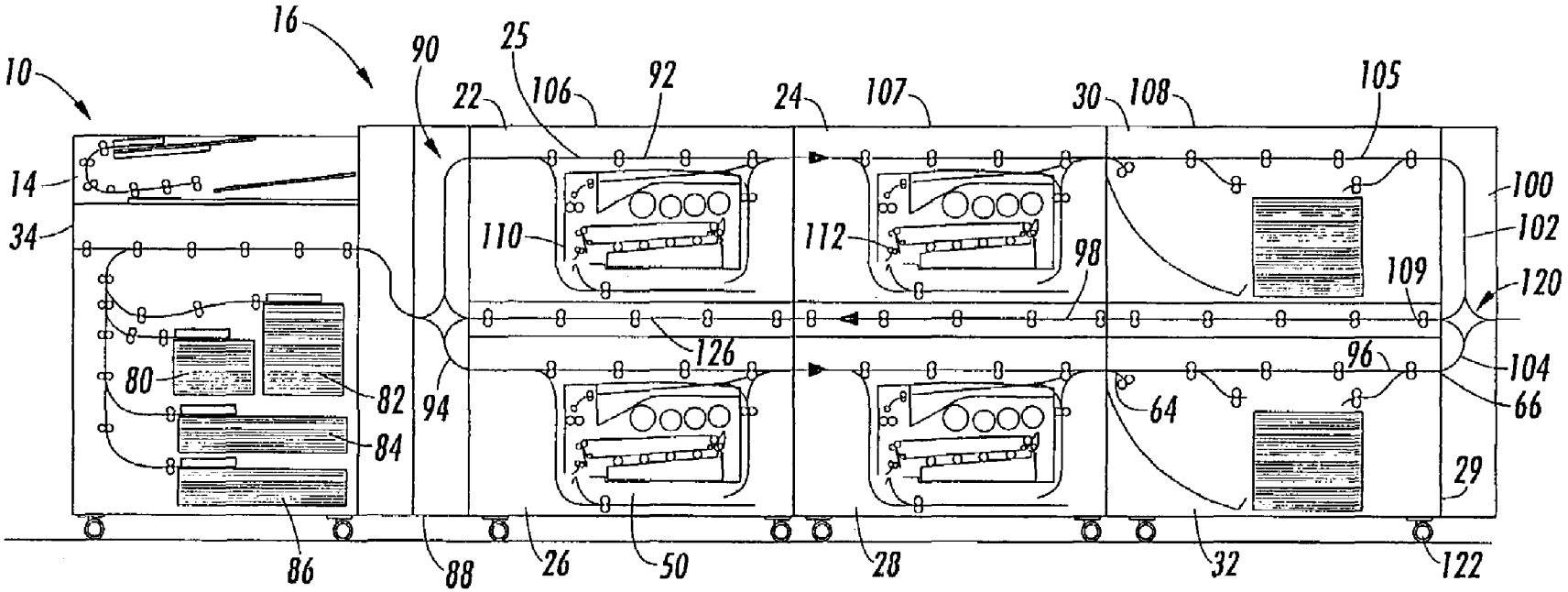
FIG. 6 is a side sectional view of the printing assembly of FIG. 2, in which the modules are in stacked towers.

With reference to FIG. 6, a printing system 10 includes a printer assembly 16 of the type illustrated in FIG. 2, in which two of the printing modules 22, 24 are vertically stacked on top of two other printing modules 26, 28 and output modules 30, 32 are vertically stacked one on top of the other, is illustrated. The feeder system 34 includes a plurality of paper sources, here illustrated by trays 80, 82, 84, 86, which supply print media via a first interface module 88 to the printer modules 22, 24, 26, 28. Specifically, the interface module 88 includes a first pathway 90 which connects the feeder with an upper forward print media highway 92 and a second pathway 94 which connects the feeder with a lower forward media highway 96. The first and second media highways 92, 96 travel horizontally, and in the same direction in the illustrated embodiment. As discussed, each of the modules 22,24,26,28,20,32 includes a portion of one or other of the main downstream highways 92, 96. Specifically, modules 22,24, 30 in upper row 25 each include a portion of highway 92 and modules 28, 28, 32 in lower row 29 each include a portion of highway 96.

A return highway 98 travels horizontally in the opposite direction and connects the down stream ends of the forward highways 92,96 with their upstream ends. Specifically, a second interface module 100 extends vertically adjacent to the two downstream modules 30, 32 and includes first and second pathways 102 and 104 which connect the downstream ends of forward highways 92 and 96 with the return highway 98. As previously described, each of the modules carries a portion of a highway, the upper row of modules 22, 24, 30 carrying a portion of the upper highway 92 and the lower row of modules 26, 28, 32 carrying a portion of the lower highway 96. As a result, a network 105 of pathways 90, 94, 96, 98, etc. is created by which the output of any one printer module can be directed to the input of the same or another printer module or of any output module and optionally, the output of any output module can be directed to the input of the same and/or any other output module, or even of a printer module.

In the illustrated embodiment, stacked pairs of modules form respective towers or columns 106, 107, 108 and the return highway 98 is carried by an interface module 109 (one for each tower) carried by the respective towers, intermediate the upper and lower modules, although it is also contemplated that the return highway, or portions thereof, may be carried by one or more of the modules 22,24,26,28, 20,32. For example, each of the modules 22,24,26,28,20,32 may carry a portion of a return highway 98 in a similar manner to the main highway 92, 96 and there may be two or more return highways, one for each row of modules. Other arrangements are contemplated, for example, main highway 92 may be a downstream highway and main highway 96 may be a return highway (with modules 26, 28, 32 arranged such that their input and output interfaces are reversed), in which case, highway 98 can be eliminated. Additionally, all or portions of highways 92, 94, and/or 96 can be vertically or otherwise oriented.

A capability shown in FIG. 6 is the ability of media to be marked by any first marking engine and then by any one or more subsequent marking engine to enable, for example, single pass duplexing and/or multi-pass printing. Single pass duplexing or multi-pass printing can be accomplished by any two (or more) marking engines, for example marking engines 110 and 112 of modules 22 and 24, oriented generally horizontally to one another, where the second marking engine 112 is positioned downstream from the first or originating marking engine 110. Alternatively, single pass duplexing/multi-pass printing can be accomplished by any pair of marking engines oriented vertically or horizontally adjacent, or non-adjacent, to one another.

Although not illustrated, it is to be appreciated that at intersections along the horizontal highways and at alternative routes entering and exiting the marking engines, switches or dividing members are located and constructed so as to be switchable to allow sheets or media to move along one path or another depending on the desired route to be taken. The switches or dividing members can be electrically switchable between at least a first position and a second position. An enabler for reliable and productive system operation includes a centralized control system that has responsibility for planning and routing sheets, as well as controlling the switch positions, through the modules in order to execute a job stream.

Media can be discarded by way of discard paths in the printer and/or output modules, or elsewhere in the system. Media discarded can be purged from the system at the convenience of the operator and without interruption to any current processing jobs.

Optionally, the downstream interface module 100 is configured for connecting the network 105 with an output path 120 to allow print media to be directed to non-containerized finishing devices or elsewhere.

In FIG. 6, the input and output interfaces of the adjacent modules connect directly to each other. For example, the housings 40, 60 may be provided with a suitable latching mechanism which ensures that the adjacent modules maintain their alignment. The lower row modules 26, 28, 32 may be fitted with wheels 122 or other means for movement for ease of interchangeability and replacement.

Figure 7:
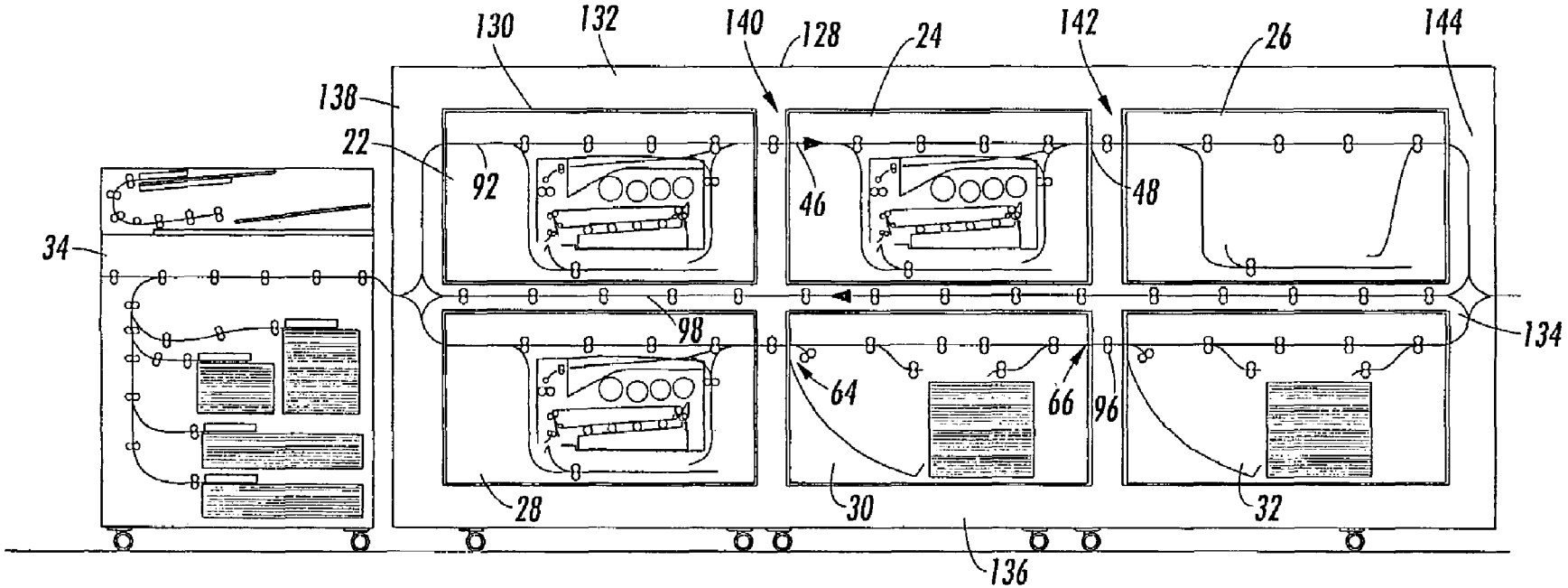
FIG. 7 is a side sectional view of the printing assembly of FIG. 2, in which the modules are stacked in a tower structure.

In another embodiment, illustrated in FIG. 7, in which the modules can be similarly configured to those of FIG. 6, the modules are located in a tower structure 128 in which modules are stacked horizontally and vertically. The tower structure 128 includes a plurality of docking ports 130 which receive the various modules. In this embodiment, the tower structure may include horizontal members 132, 134, 136, which carry one or more of the highways 92, 96, 98, and vertical members 138, 140, 142, 144, which carry the vertical pathways in a similar manner to interfaces 90 and 100.

As illustrated in FIG. 1, a control system 150, which may be located in the print server 12 or elsewhere in the system 10, controls the delivery of print media from the feeder to the appropriate printer module(s) for printing and then to the appropriate output module(s) for finishing a particular print job. The control system may include a scheduling function, as described, for example, in U.S. application Ser. No. 10/284,560, filed Oct. 30, 2002, for PLANNING AND SCHEDULING RECONFIGURABLE SYSTEMS WITH REGULAR AND DIAGNOSTIC JOBS, by Fromherz; U.S. application Ser. No. 10/284,561, filed Oct. 30, 2002, for PLANNING AND SCHEDULING RECONFIGURABLE SYSTEMS WITH ALTERNATIVE CAPABILITIES by Fromherz; and U.S. application Ser. No. 10/424,322, filed Apr. 28, 2003, for MONITORING AND REPORTING INCREMENTAL JOB STATUS SYSTEM AND METHOD by Fromherz, and copending application Ser. No. 10/924,458, filed Aug. 23, 2004, entitled PRINT SEQUENCE SCHEDULING FOR RELIABILITY, the disclosures of which are incorporated herein in their entireties by reference.

For example, the scheduling system may determine that a particular job is best performed (e.g., in terms of print quality, efficiency or both) by a particular subset of the printer modules and/or output modules and direct the paper accordingly. In the event that one of the printer modules or output modules is not performing satisfactorily or requires maintenance, the scheduler or control system 150 redirects the print jobs scheduled to go to that printer module or output module to one or more other modules. Thus, the print job may be able to continue (provided other modules provide the desired finishing and/or printing capabilities) albeit at a lower throughput. The controller, via a display (D) 152 or other operator interface, may instruct an operator to remove the submodule of the faulty module or the entire faulty module from the system. If a replacement submodule/module is on hand, the faulty submodule/module can be immediately replaced with a new submodule/module of the same or a similar configuration. Printing need not be interrupted for a submodule replacement, since the paper path network remains substantially intact, as illustrated in FIG. 7, which illustrates the printing submodule 50 of printer module 26 having been removed. In the case of a replacement of an entire module, printing may be halted during replacement. If the desired replacement module is not immediately available, another module of any type may be temporarily inserted to complete the paper path 105, allowing printing to restart, albeit with reduced capabilities. In the embodiment of FIG. 6, a complete tower comprising the faulty module may be removed and/or replaced.

The printer assembly can be reconfigured to suit the particular print jobs to be handled. For example, a user may have a particular print job which requires a specialized finishing capability not provided by any of the output modules 30, 32 currently in the printer assembly 16. The user switches one of the existing output modules/submodules for a module/submodule having the specialized finishing capabilities and the printing system handles the job. This can be achieved without stopping the printing system by scheduling the changeover for a period of time when the remaining output module(s) can handle the finishing requirements of the jobs being printed at the time. When the job with the specialized finishing capability is complete, the specialized output module/submodule is removed from the system. Rather than removing one of the existing modules, it will be appreciated that the system may be reconfigured by adding one or more modules. For example, in the system of FIG. 6, module 100 is disconnected from the system and an additional tower comprising two additional stacked modules is added between modules 24, 28 and interface module 100. One or both of the added modules may comprise an output module. Having the facility to add or replace modules allows the system to perform a print job or a series of print jobs with fewer finishing capabilities than are normally present in a finishing device.

The modular architecture of the printing system described above employs at least two marking engines, and at least two output modules, with associated input/output media paths which can be stacked "two up" inside a supporting frame to form a basic "two up" module with two marking engines (more than two modules may be stacked, i.e., "three up," etc.). The modular architecture can include additional marking engines and feeder modules which can be "ganged" together in which the horizontal highways can be aligned to transport media to/from the marking engines. The system can include additional horizontal highways positioned above, between, and/or below the ganged marking engines. It is to be appreciated that the highways can move media at a faster transport speed than the internal marking engine passes paper.

The modular media path architecture provides for a common interface and highway geometry which allows different marking engines and/or output modules with different internal media paths together in one system. The modular media path includes entrance and exit media paths which allow sheets from one marking engine to be fed to another marking engine, either in an inverted or in a non-inverted (by way of a bypass) orientation.

The modular architecture enables a wide range of marking engines/output modules in the same system. As described above, the marking engines can involve a variety of types and processing speeds. The modular architecture can provide redundancy for marking engines, output finisher devices and paths. The modular architecture can utilize as little as a single media source on the input side, a single printer module and a single output module on the output side. It is to be appreciated that an advantage of the system is that it can achieve very high productivity, using marking processes in elements that do not have to run at high speeds and marking/finishing processes that can continue to run while other marking engines/finishers are being serviced. This simplifies many subsystems such as fusing, and allows use of lower priced marking engines and output modules. Although not shown, other examples of the modular architecture can include an odd number of marking engines and/or output modules. For example, three marking engines can be configured such that two are aligned vertically and two are aligned horizontally, wherein one of the marking engines is common to both the vertical and horizontal alignment.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A system comprising:

at least first and second marking modules, each of the marking modules including a marking engine;

at least one media feeder which feeds print media to the marking engines;

first and second output modules which receive print media from the first and second marking modules, the first and second output modules each including a finisher, the finisher of the first output module having at least one finishing capability which differs from a finishing capability of the finisher of the second output module; and at least one print media network which selectively conveys print media between each of the marking modules and each of the output modules, the first and second output modules each comprising a portion of the print media network, the portion extending between an inlet interface and an outlet interface.

2. The system of claim 1, wherein the portion of the print media network of the first output module enables the finisher of the first output module to be bypassed.

3. The system of claim 1, wherein the first and second marking modules each include a portion of the at least one print media pathway which enables the marking engines of the first and second marking modules to be bypassed.

4. The system of claim 1, wherein the marking engine modules and output modules each have a footprint which is similar to a footprint of an adjacent module, whereby a module is replaceable with another module having a similar footprint.

5. The system of claim 4, wherein the modules are interchangeable with each of the other modules.

6. The system of claim 1, wherein at least one of the modules is interchangeable with a module from the same row.

7. The system of claim 1, wherein the finishers of the first and second output modules are selected from the group consisting of sorters, mailboxes, inserters, interposers, folders, staplers, hole punchers, stackers, collaters, stitchers, binders, envelope stuffers, postage machines, and combinations thereof.

8. The system of claim 1, wherein the at least two image marking engines are generally vertically aligned.

9. The system of claim 1, wherein at least one of the output modules is generally vertically aligned with another of the output modules or with a marking engine module.

10. The system of claim 9, wherein the first and second generally horizontal media transport pathways are forward pathways, the system further including a return generally horizontal interface media transport pathway which has a first end which is connected with a first end of each of the first and second forward generally horizontal media transport pathways and a second end which is connected with a second end of each of the first and second forward generally horizontal media transport pathways for transporting media in a second direction.

11. The system of claim 1, wherein at least first and second of the marking engine and output modules are arranged in a first row and at least third and fourth of the marking engine and output modules are arranged in a second row, the portions of the media network of the first and second modules comprising a first generally horizontal media transport pathway and the portions of the media network of the third and fourth modules comprising a second generally horizontal media transport pathway.

12. The system of claim 11, wherein said first return horizontal transport is positioned intermediate the first and second forward generally horizontal media transport pathways.

13. The system of claim 11, wherein said first direction and said second direction are generally opposite.

14. A xerographic printing system comprising the system of claim 1.

15. A system comprising:

at least first and second marking modules, each of the marking modules including a marking engine;

at least one media feeder which feeds print media to the marking engines;

first and second output modules which receive print media from the first and second marking modules, the first and second output modules each including a finisher; and at least one print media network which selectively conveys print media between each of the marking modules and each of the output modules, the first and second output modules each comprising a portion of the print media network, the portion extending between an inlet interface and an outlet interface, at least one of the inlet interface and the outlet interface of each of the modules is at the same height as the corresponding outlet interface or inlet interface of an adjacent module.

16. The system of claim 15, wherein the finisher of the first output module has at least one finishing capability which differs from a finishing capability of the finisher of the second output module.

17. The system of claim 16, wherein the finisher of the first output module and the finisher of the second output module have the capability to perform at least one finishing process which is the same.

18. A system comprising:

at least first and second marking modules, each of the marking modules including a marking engine;

at least one media feeder which feeds print media to the marking engines;

first and second output modules which receive print media from the first and second marking modules, the first and second output modules each including a finisher; and at least one print media network which selectively conveys print media between each of the marking modules and each of the output modules, the first and second output modules each comprising a portion of the print media network, the portion extending between an inlet interface and an outlet interface, the finisher of the first output module being removable from the module without interrupting flow of print media to the finisher of the second output module.

19. A method of printing comprising:

feeding print media to first and second marking engines;

marking the print media with the first and second marking engines;

conveying the print media from the first and second marking engine to a selected one of first and second output modules;

performing a finishing process in the one of the first and second output modules, wherein the conveying of the print media includes conveying the print media on print media network, each of the output modules including a portion of the print media network; and removing the finisher of the first output module from the first output module without interrupting flow of print media to the finisher of the second output module.

20. The method of claim 19, wherein, in the event that one of the output modules becomes unable to perform a finishing process, performing the finishing process in the other of the output modules.

21. The method of claim 20, wherein the replacement of the one of the output modules with a replacement output module is performed while another of the output modules performs a finishing process.

22. The method of claim 19, wherein, in the event that any one of the output modules is unable to perform a selected finishing process, replacing one of the output modules with a replacement output module.

23. An integrated printing system comprising:

a plurality of modules comprising:

a plurality of image marking modules which receive print media from a common stream, and a plurality of output modules which perform a finishing process on print media received from the image marking modules; and a network of pathways which enables print media to travel from any one of the plurality of modules to any other of the plurality of modules, each of the plurality of modules being interchangeable with each of the other modules in the plurality of modules.

24. The integrated printing system of claim 23, wherein each of the modules carries a portion of the network of pathways.

* * * * *